US005806931A

United States Patent [19]

Kogai

[11] Patent Number: 5,806,931

[45] Date of Patent: Sep. 15, 1998

[54] METHOD FOR INCLINING THE BACKREST OF A CHAIR, AND CHAIR HAVING AN INCLINABLE BACKREST

[75] Inventor: Koichi Kogai, Nagoya, Japan

[73] Assignee: AICO Co., Ltd., Nagoya, Japan

[21] Appl. No.: 740,989

[22] Filed: Nov. 5, 1996

[30] Foreign Application Priority Data

Nov. 6, 1995 [JP] Japan ..... 7-313603

[51] Int. Cl.[6] ..... A47C 3/00

[52] U.S. Cl. ..... 297/301.3; 297/452.2

[58] Field of Search ..... 297/452.18, 452.2, 297/301.1, 301.3, 446.2, 447.3, 447.2, 447.1, 448.2, 285

[56] References Cited

U.S. PATENT DOCUMENTS 4,548,441 10/1985 Ogg .
5,123,702 6/1992 Caruso .
5,348,367 9/1994 Mizelle .
5,350,215 9/1994 DeMars .
5,383,712 1/1995 Perry .
5,385,388 1/1995 Faiks et al. .
5,449,220 9/1995 Taylor et al. .
5,452,937 9/1995 Piretti .

*Primary Examiner*—Milton Nelson, Jr.
*Attorney, Agent, or Firm*—Wenderoth, Lind & Ponack, L.L.P.

[57] ABSTRACT

The device relates to a method for inclining the backrest of a chair, and a chair having an inclinable backrest, the structure of which is simplified to ensure easy inclination of the backrest and easy adjustment of the inclination force (locking force). An upper member of a backrest tubular frame is divided, and the divided upper members are disposed in parallel to each other with an appointed interval maintained in the vertical direction therebetween. The backrest is attached to both the upper members so that the lower part of the backrest is brought into contact with a lower member of the backrest tubular frame. A hypothetical rotating axis is formed between the upper members, and the backrest can be inclined by user's weight against a twisting force of both the upper members of the backrest tubular frame.

12 Claims, 16 Drawing Sheets

METHOD FOR INCLINING THE BACKREST OF A CHAIR, AND CHAIR HAVING AN INCLINABLE BACKREST

TECHNICAL FIELD

The present invention relates to a method for inclining the backrest of a chair, and a chair having an inclinable backrest.

BACKGROUND OF THE INVENTION

Conventionally, the backrest has been merely attached to the upper member and lower member of the backrest tubular frame with fixing members such as bolts as a method for attaching the backrest to the backrest attaching plate.

Furthermore, as a method for inclinably attaching the backrest, the backrest has been only rotatably attached to the upper member of the backrest tubular frame.

With a method for fixing the backrest via conventional fixing members, since the backrest is not inclinable, there has been such a problem that a user is liable to get tired if he or she is seated for a long period of time.

SUMMARY OF THE INVENTION

In view of these problems and shortcomings, it is therefore an object of the present invention to provide a method for inclining the backrest of a chair, and a chair having an inclinable backrest, which facilitates the inclination of the backrest and also facilitates the adjustment of the inclination force (locking force), and the structure of which is simple.

A method according to the invention is characterized in that in a chair having a backrest tubular frame consisting of an upper member, both-side members and a lower member, the upper member of the backrest tubular frame is divided into two, the divided upper members are disposed in parallel to each other with an appointed interval provided therebetween in the vertical direction. The backrest is attached to both the upper members so that the lower part of the backrest is brought into contact with the lower member of the backrest tubular frame. A hypothetical rotating axis is formed between the upper members, and the backrest is inclinable by a user against a twisting force of the upper members of the backrest tubular frame, by pivoting around the hypothetical rotating axis. Alternatively, in a chair having a backrest tubular frame consisting of an upper member, the upper member of the backrest tubular frame is divided into two, each of the divided upper members is caused to extend upward or downward, or one of the divided upper members is caused to extend upward, and the other of the divided upper members is caused to extend downward, or the upper member of the backrest tubular frame is curved downward at the middle part thereof. In another alternative, an elastic band is disposed in parallel to the upper member between the upper member and lower member of the backrest tubular frame, a backrest attaching plate is pivotally mounted at the upper member of the backrest tubular frame, and simultaneously the band is fixed, and the backrest is attached to the backrest attaching plate. With the upper member constituting a rotating axis, the backrest can be inclinable by a user against the elasticity of the band.

A chair according to the invention is characterized in that a backrest tubular frame includes an upper member divided into two members, side members and a lower member. The divided upper members are disposed in parallel to each other with an appointed interval therebetween in the vertical direction. The backrest is attached to both the upper members so that the lower part of the backrest is brought into contact with the lower member of the backrest tubular frame. The backrest is inclinable by a user against a twisting force of both the upper members of the backrest tubular frame by pivoting around the hypothetical rotating axis formed between the upper members. The divided upper members may include upwardly extending upper ends or downwardly extending lower ends, or one of the divided upper members may include an upwardly extending upper end while the other of the upper members includes a downwardly extending lower end. The upper member of the backrest tubular frame may be curved downward at the middle part thereof, or a band having elasticity may be disposed in parallel to the upper member between the upper member and the lower member of the backrest tubular frame, and simultaneously a backrest attaching plate is pivotally seated at the upper member of the backrest tubular frame, wherein with the upper member defining a rotating axis, the backrest is inclinable by a user against the elasticity of the band.

With a conventional method for inclinably attaching the backrest, it is difficult to incline the backrest to the inclination degree best suited for a user, and the backrest is frequently inclined during use since no inclination force (locking force) is provided, thereby causing such a problem to occur that the user is likely to get tired if he or she is seated for a long period of time.

According to the present invention, a method is provided for inclining the backrest of a chair and a chair having an inclinable backrest is provided. The backrest is inclinable by a user against a twisting force of the divided upper members of the backrest tubular frame, and an optimal inclination force (locking force) matching the weight of a user is produced, whereby it is possible to give a user a sense of comfortable seating.

Furthermore, when adjusting the inclination force (locking force), if the interval between the respective divided upper members of the backrest tubular frame is made smaller, the inclination force (locking force) is decreased, and if the interval between the respective upper members is made larger, the same is increased. That is, it is possible to easily control the inclination force (locking force) by adjusting the interval therebetween.

Furthermore, the legs are not deformed by the twisting thereof since the twisting of the upper members of the backrest tubular frame is lightened in the inclination of the backrest. Therefore, it is possible to use a chair for many years without extraordinarily increasing the strength of the legs.

Still further, by causing the middle of the upper member to be curved downward without dividing the upper member of the backrest tubular frame, the same effect can be obtained.

If the structure is composed so that a band having elasticity is disposed between the upper member and lower member of the backrest tubular frame without dividing the upper member of the backrest tubular frame, a backrest attaching plate is pivotally seated at the upper member, and simultaneously the band is fixed thereat, and the backrest is attached to the backrest attaching plate. The backrest is inclinable by a user against not only a twisting force of the backrest tubular frame but also against the elasticity of the band.

Further details and advantages of this invention will be seen in the accompanying drawings and following description of preferred embodiments.

DESCRIPTION OF PREFERRED EMBODIMENTS

Figure 1:
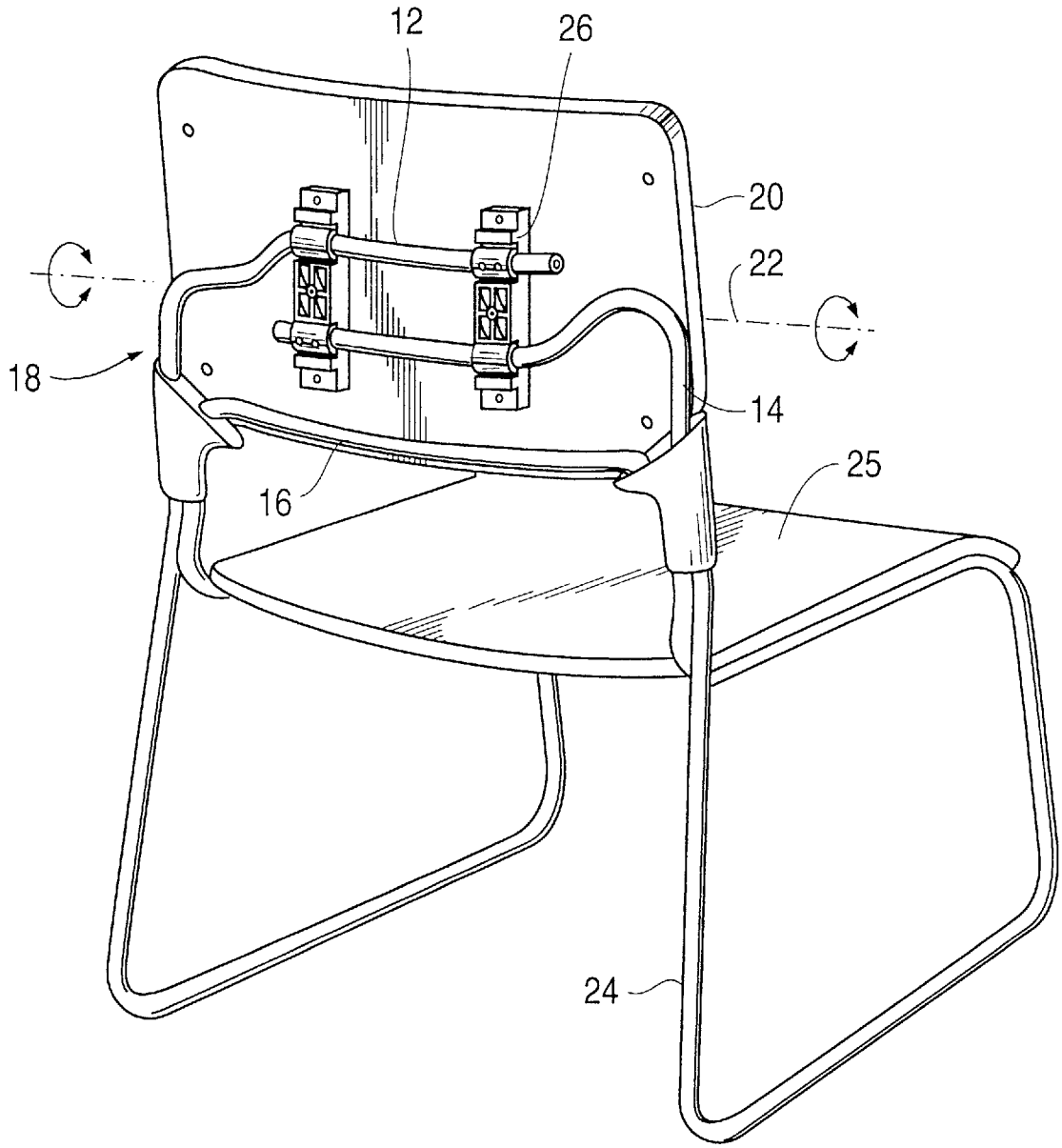
FIG. 1 is a rear perspective view of a chair having an inclinable backrest according to the invention.
Figure 2:
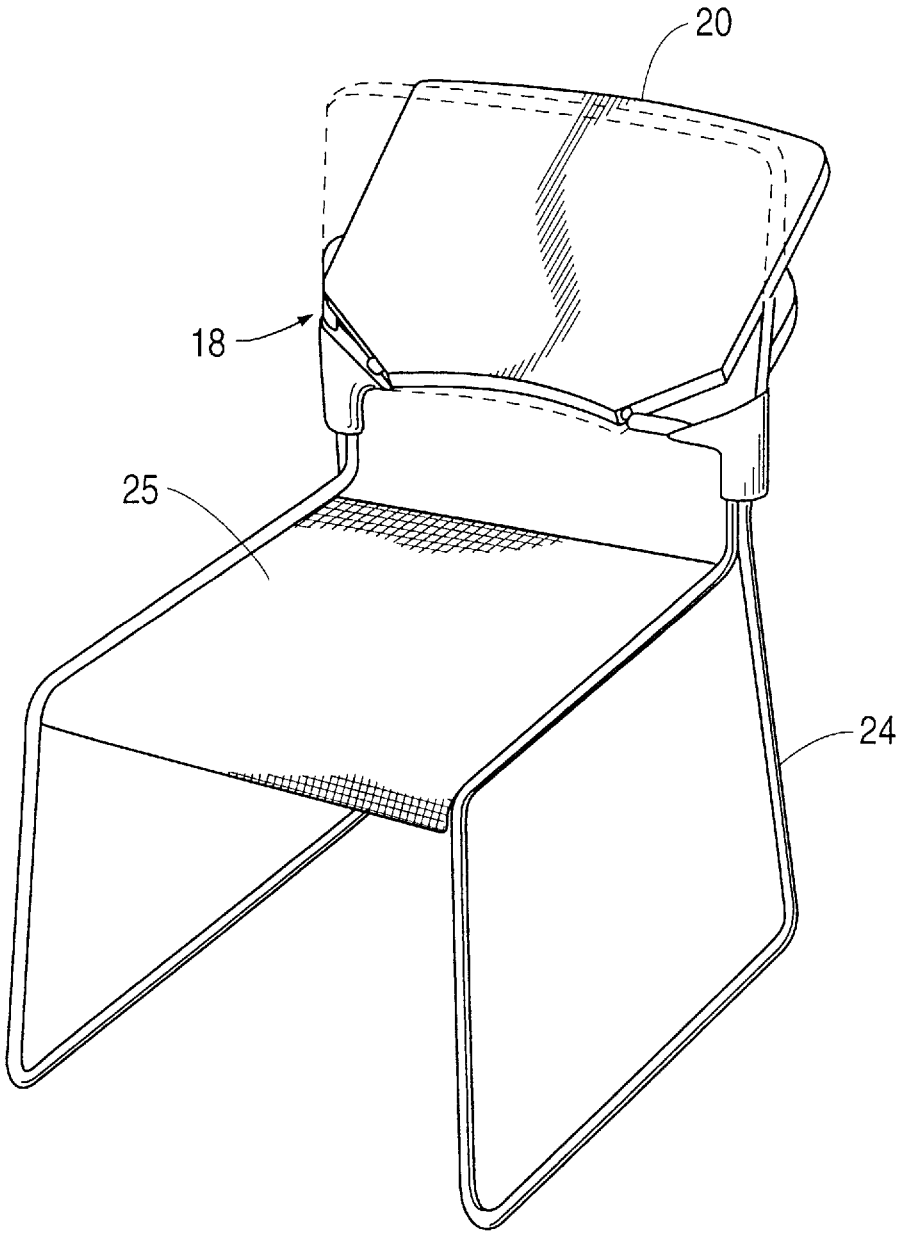
FIG. 2 is a front perspective view of said chair.
Figure 3:
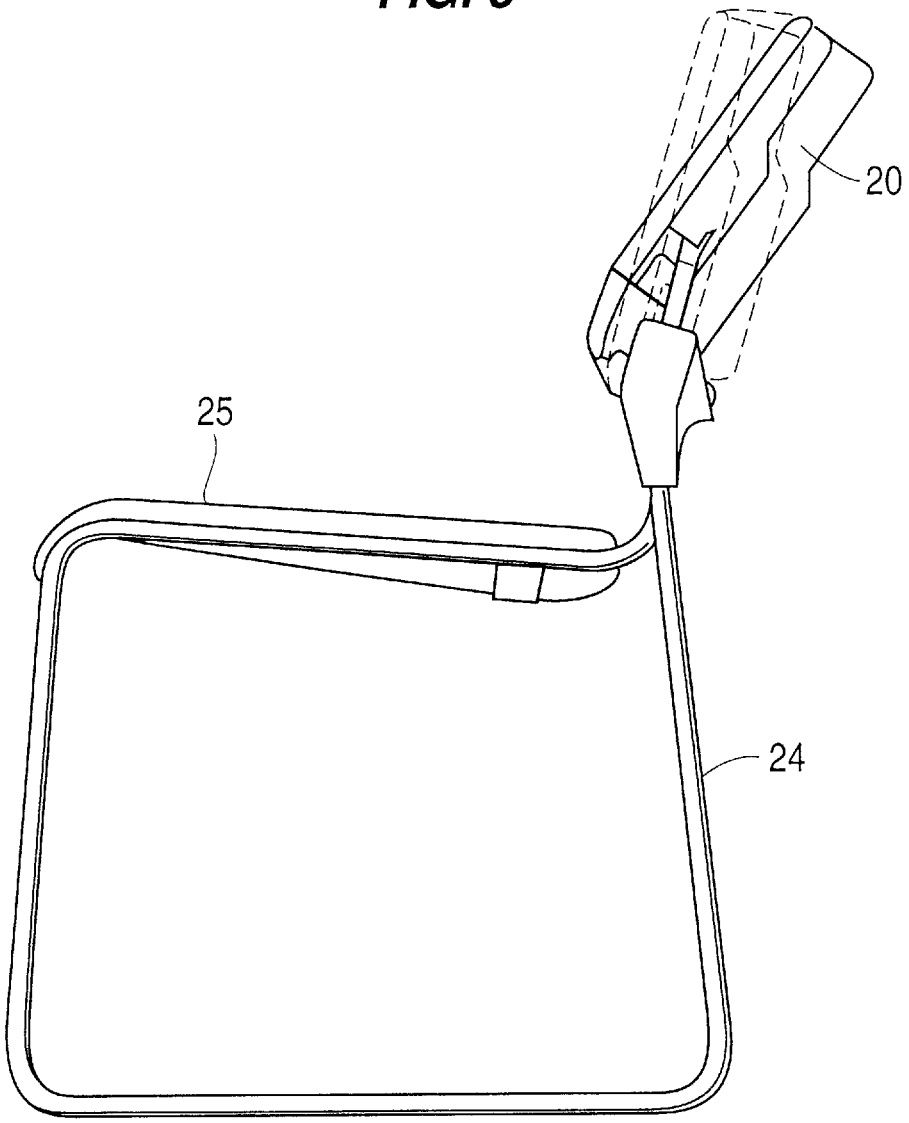
FIG. 3 is a side view of said chair.
Figure 4:
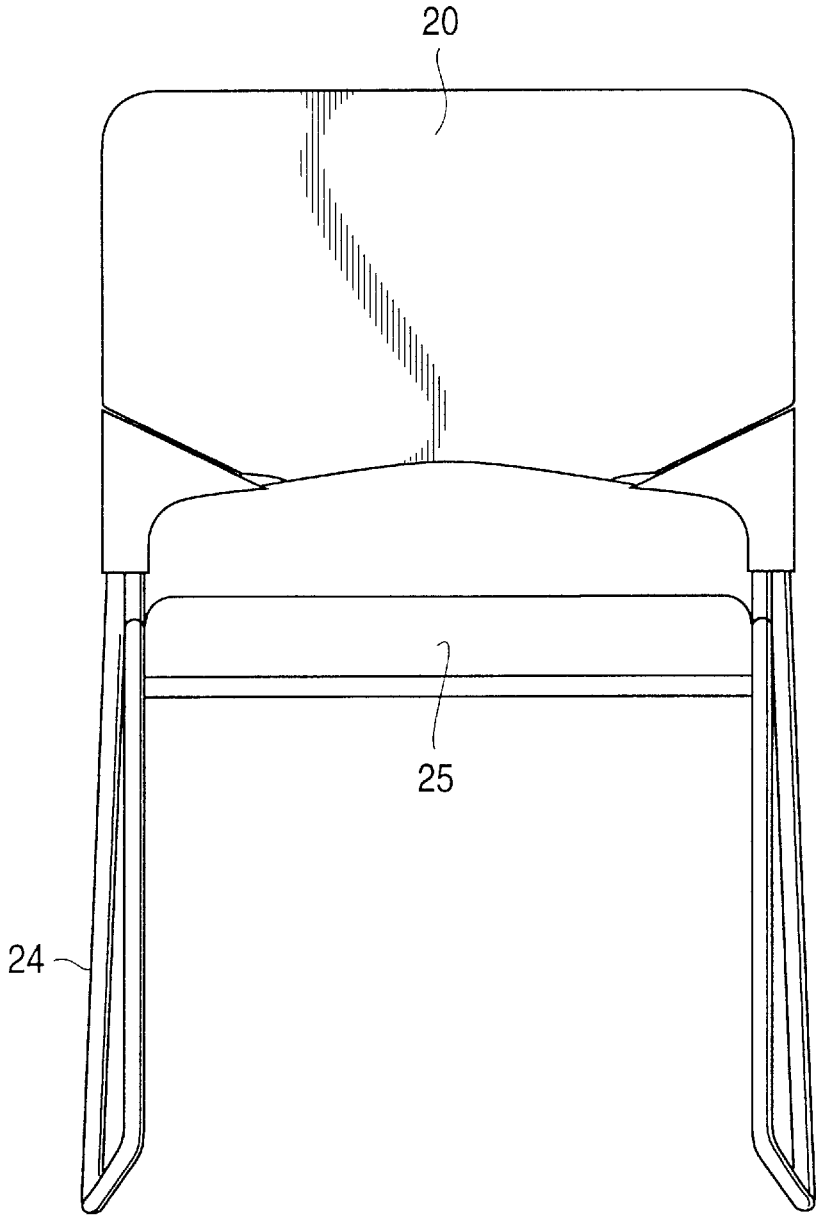
FIG. 4 is a front elevational view of the chair.

A chair according to the invention is a rotatable chair having leg portions formed by tubular frames, and the rotatable chair may be elevatable.

The chair has an inclinable backrest 20 according to the invention and includes the following features as shown in FIG. 1 through FIG. 4.

A backrest tubular frame 18 consists of an upper member 12, side members 14 and a lower member 16. The upper member 12 is divided into two upper members.

Both the divided upper members are disposed in parallel to each other with an appointed interval maintained in the vertical direction between the divided upper members 12.

In this preferred embodiment, the interval between both the upper members 12 is around 100 mm which is greater than the diameter of the backrest tubular frame 18, and in particular 20 to 30 mm is most preferable.

Furthermore, it is possible to adjust the inclination force (locking force) of the backrest by setting the interval between both the upper members 12. For example, if the interval between both the upper members 12 is made smaller, the inclination force (locking force) is made smaller while, if the interval between the upper members 12 is made larger, the inclination force (locking force) is made stronger.

Therefore, it is possible to easily control the inclination force (locking force) of the backrest 20 by adjusting the interval between the respective divided upper members.

The backrest 20 is attached to both the upper members 12 so that the lower part of the backrest 20 is brought into contact with the lower member 16 of the backrest tubular frame 18.

In this preferred embodiment, each of the divided upper members 12 is curved upward or downward (as illustrated in FIG. 1) adjacent the portions thereof attached to the side members 16. Otherwise, the respective upper members 12 are almost entirely parallel to each other.

The hypothetical rotating axis 22, formed between the attachment positions of the backrest 20 and the respective upper members 12 is stabilized (is made horizontal) by placing the curved starting points (i.e. the points at which the upper members 12 join the side members 14) of the respective upper members 12 at almost the same vertical position.

Furthermore, the backrest 20 is attached to both the upper members 12 so that both the upper members 12 are positioned at the vertically middle portion of the backrest 20.

This is so that, since the hypothetical rotating axis 22 of the backrest 20 exists at the middle in the vertical (height) direction of the backrest 20, the backrest 20 is caused to be easily inclined when a user places his or her weight onto the backrest 20.

When a user places his or her weight onto the backrest 20, both the upper members 12 of the backrest tubular frame 18 are twisted, thereby causing an inclination force (locking force) to be produced. This inclination force (locking force) gives the user a sense of comfortable seating.

Furthermore, since the lower part of the backrest 20 is brought into contact with the lower member 16 of the backrest tubular frame 18, it is possible to prevent the lower part of the backrest 20 from being inclined backward. That is, the lower member 16 of the backrest tubular frame 18 serves as an inclination stopper of the backrest 20.

Furthermore, the lower edge of the backrest 20 is curved upward to prevent the backrest 20 from being brought into contact with the backbone of a user when inclining the same.

A chair according to this preferred embodiment is provided with legs 24 made of tubular frames.

In the drawings, 25 is a seat and 26 is an a metal attachment fitting.

A method for inclining the backrest of a chair according to the preferred embodiment is characterized in that, by a user placing his or her weight onto the backrest 20, the backrest 20 is inclined backward by pivoting around the hypothetical rotating axis 22 formed between the respective upper members 12 of the backrest tubular frame 18.

At this time, since a pressing force (rebounding force) which causes the backrest 20 to be pushed back by a twisting of each of the upper members 12, on which the backrest 20 is attached, acts against the weight (force) applied by a user, the inclination position of the backrest 20 is thus controlled, whereby a sense of comfortable seating is given to the user.

Furthermore, the legs 24 are not deformed by the twisting of the upper members 12 since the twisting of the upper members 12 of the backrest tubular frame 18 is lightened in the inclination of the backrest 20. Therefore, it is not necessary to provide extraordinarily means for increasing the strength of the legs 24.

Figure 5:
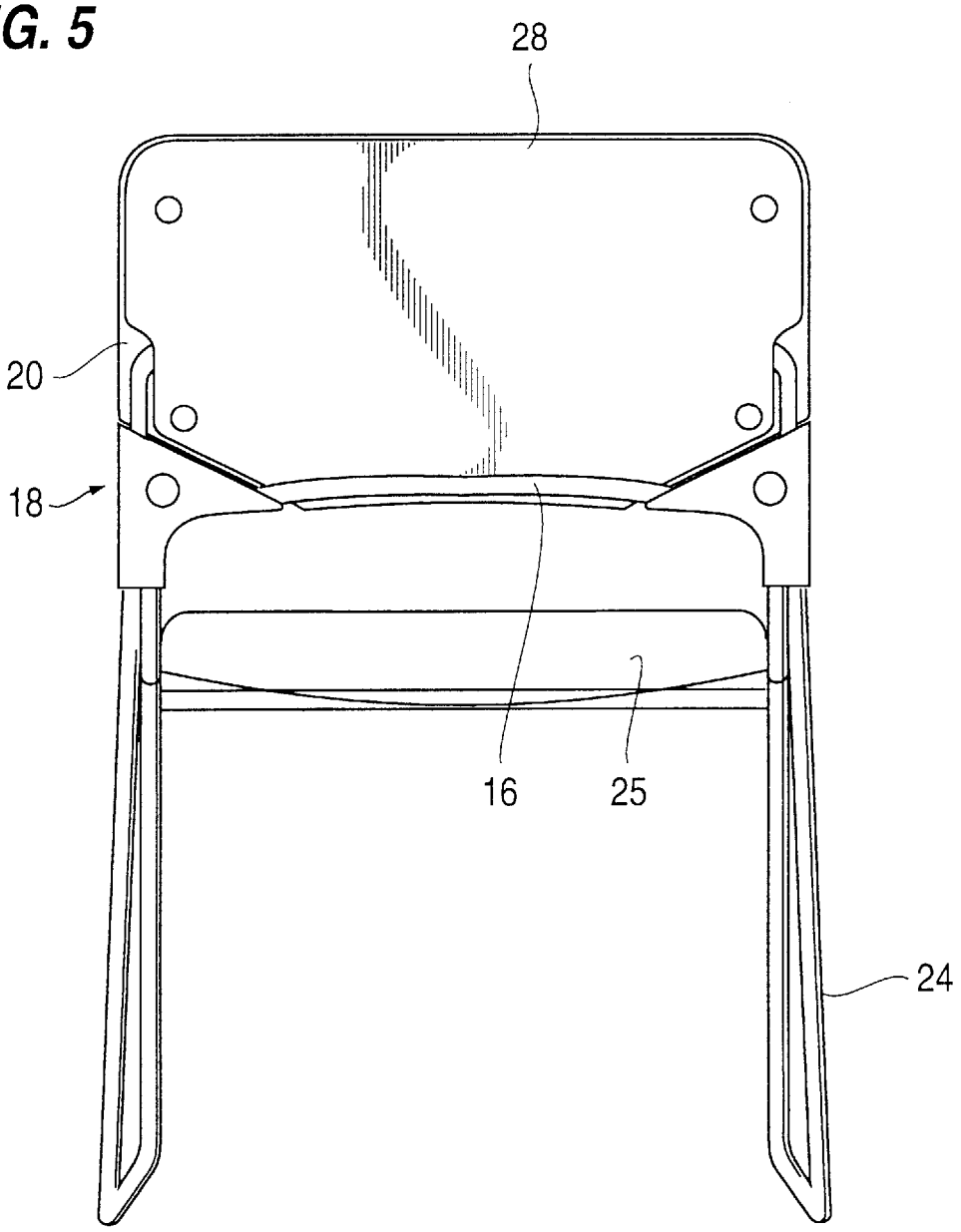
FIG. 5 is a rear side view showing a state where a cover is attached to the rear side of the backrest.
Figure 6:
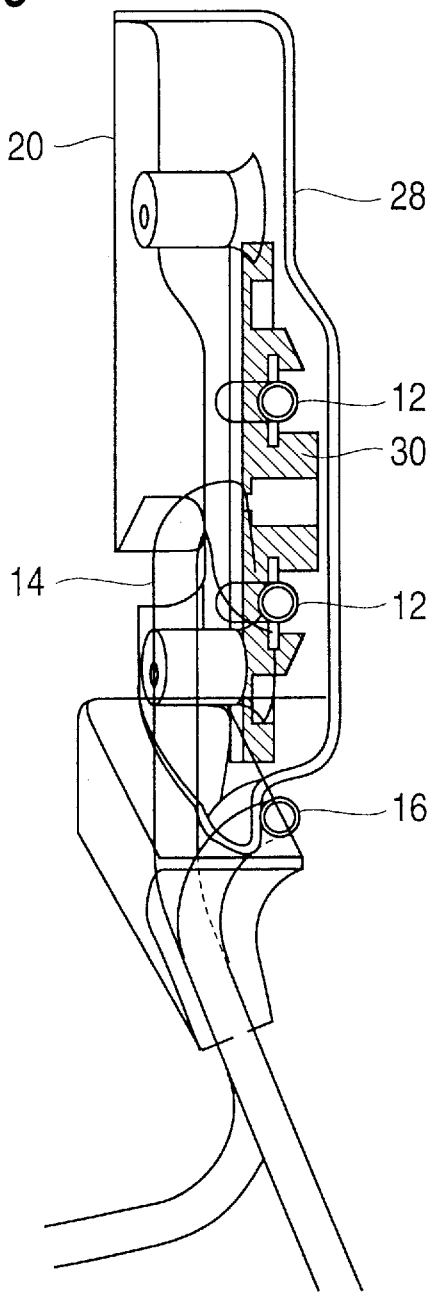
FIG. 6 is an enlarged cross-sectional view taken along the line 6—6 in FIG. 5.

FIG. 5 and FIG. 6 show another preferred embodiment of the invention.

This preferred embodiment is characterized in that the rear side of the backrest 20 of a chair according to the former preferred embodiment is enclosed with a cover 28, and all the other components are identical to those in the former preferred embodiment.

Furthermore, in the drawings, 30 is a shock-absorbing member which intervenes between the backrest 20 and the cover 28.

Figure 7:
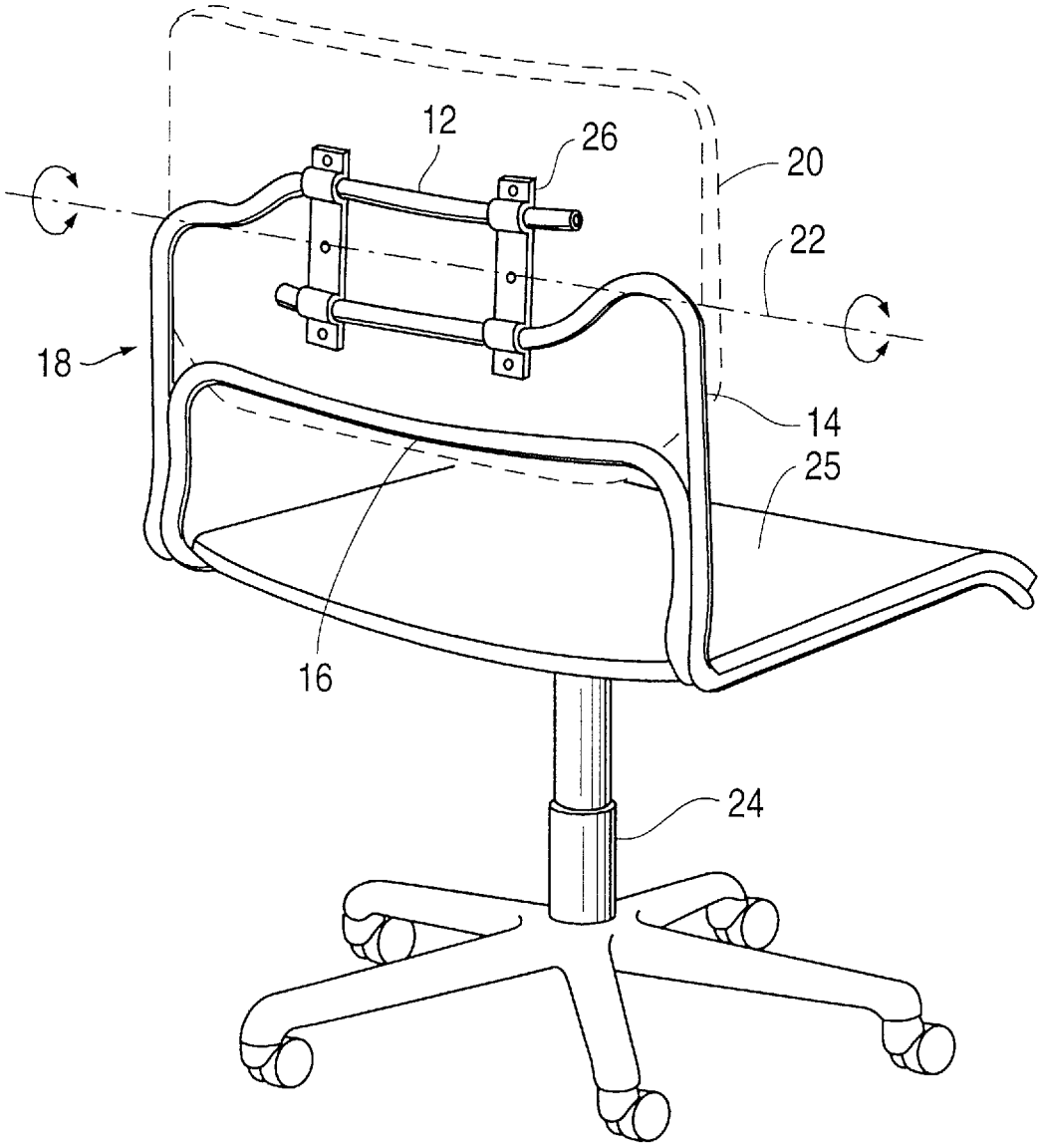
FIG. 7 is a perspective view showing the rear side of another preferred embodiment.

Still furthermore, FIG. 7 shows still another preferred embodiment.

This preferred embodiment is characterized in that the legs 24 of the chair shown in FIG. 1 through FIG. 4 are replaced by a single leg for a rotatable chair. Since all the other components are identical to those of the embodiment shown in FIG. 1 through FIG. 4, further description thereof is omitted.

Figure 8:
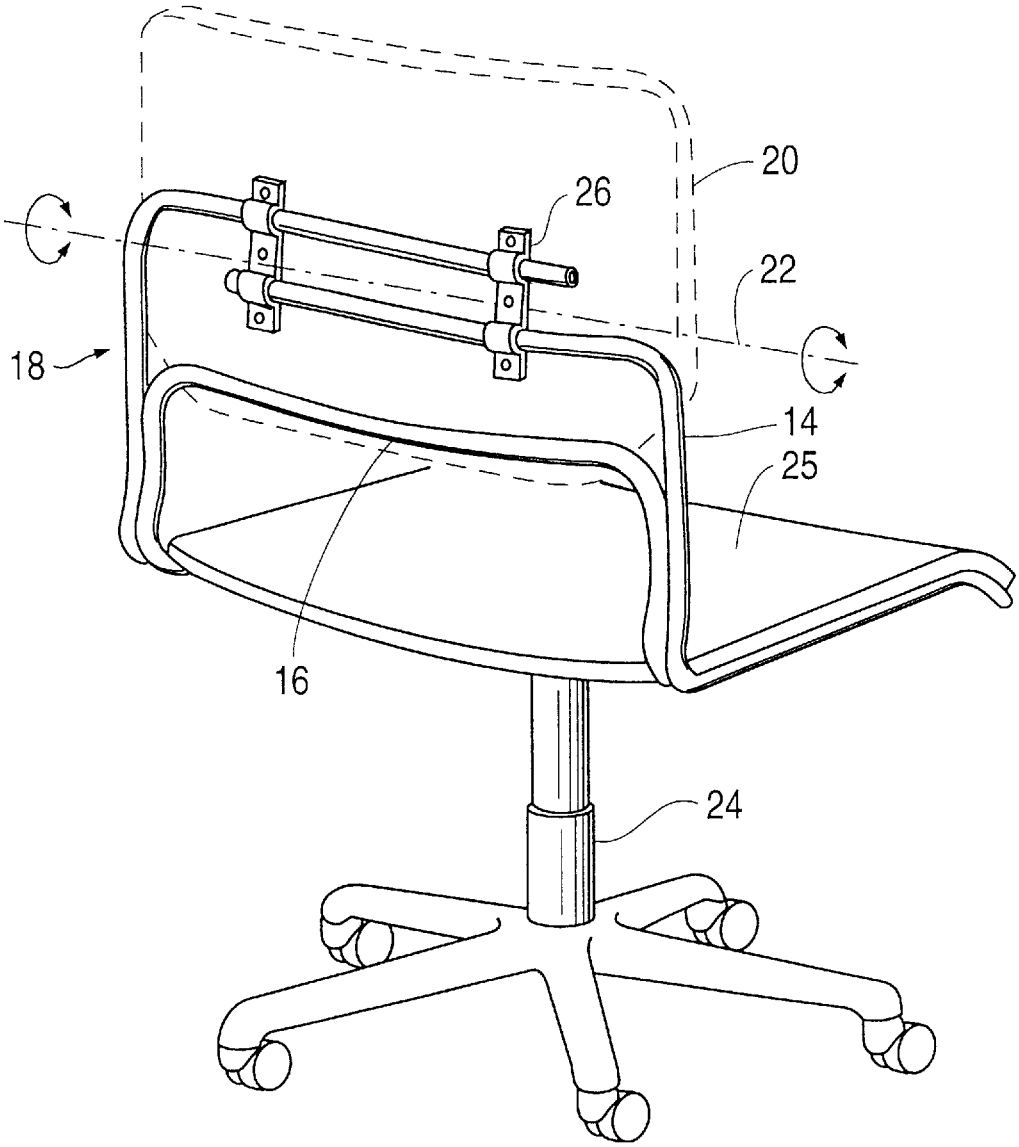
FIG. 8 is a perspective view showing the rear side of still another preferred embodiment.

FIG. 8 shows still another preferred embodiment.

This preferred embodiment is identical to the example shown in FIG. 7, excepting that the curved starting points of the divided upper members 12 of the backrest tubular frame 18 of the chair (i.e. the curved junctions between the upper member 12 and the side members 16) are not curved upward. Therefore, further description thereof is omitted.

Figure 9:
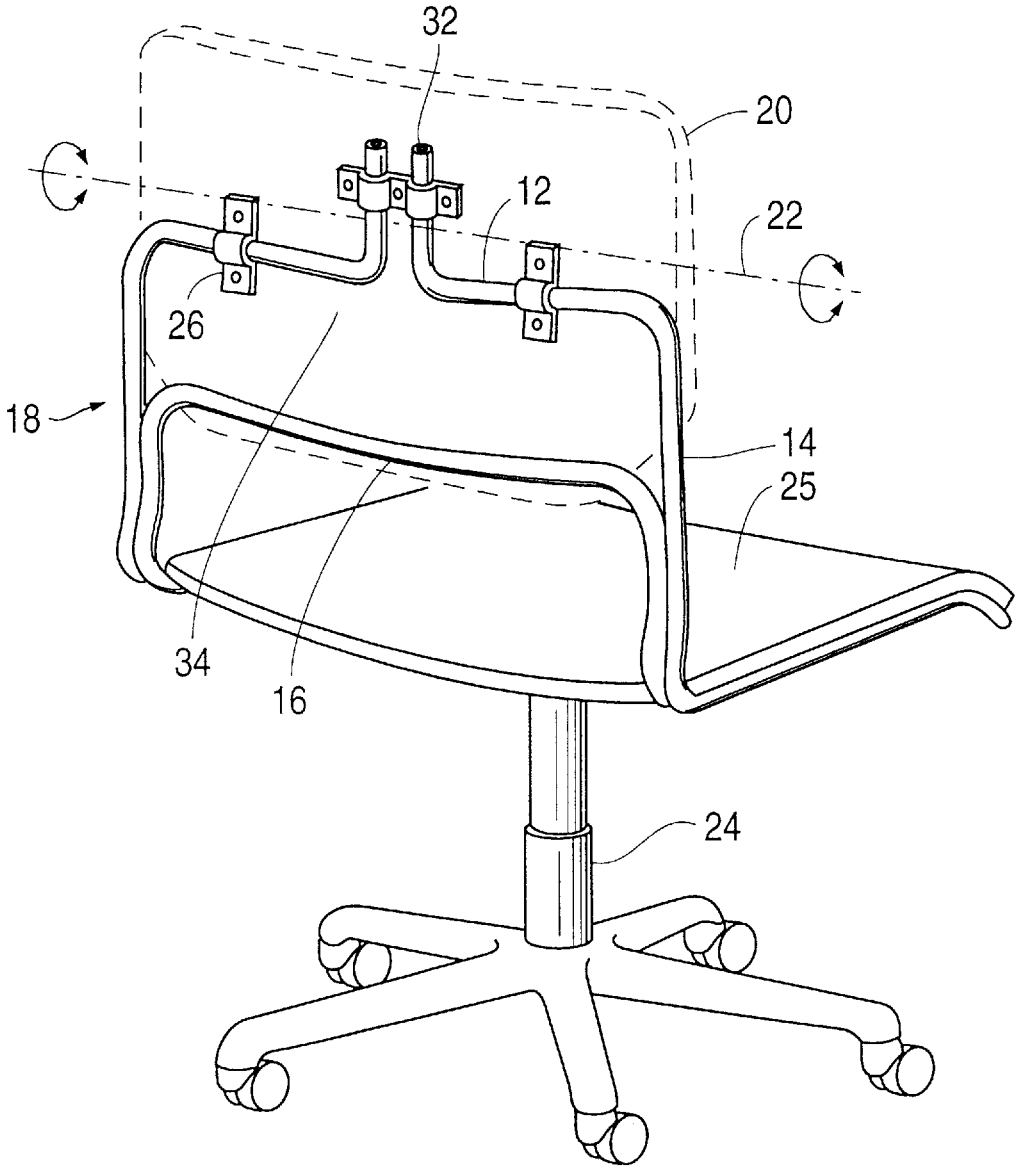
FIG. 9 is a perspective view showing the rear side of a different preferred embodiment.

FIG. 9 shows a different preferred embodiment.

This preferred embodiment is characterized in that the upper member 12 of the backrest tubular frame 18 is divided, each of the divided upper members 12 includes a base end 34 and upwardly extending upper end 32, and the backrest 20 is attached to the upwardly extending upper ends 32 of the respective upper members 12 and to the base ends 34 thereof. All the other components are identical to those in the example shown in FIG. 7.

Accordingly, a hypothetical rotating axis is formed between the upper ends 32 of the respective upper members 12 and the base ends 34 thereof, and the backrest 20 is inclined backward by pivoting around this hypothetical rotating axis 22.

Figure 10:
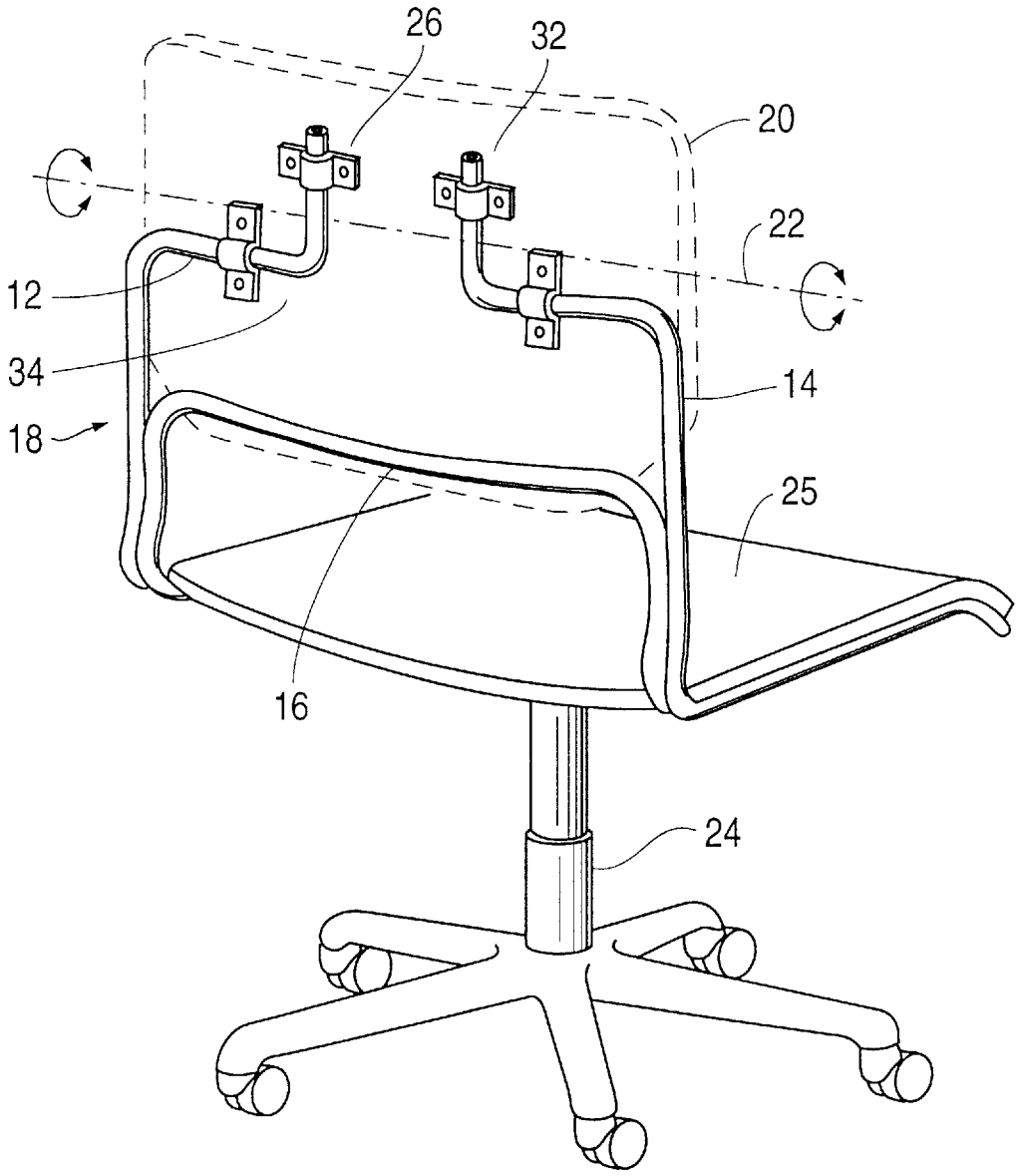
FIG. 10 is a perspective view showing the rear side of another preferred embodiment.

FIG. 10 shows another preferred embodiment.

This preferred embodiment is characterized in that an appointed interval is provided between the upwardly extending upper ends 32 of the respective upper members 12 in the chair shown in FIG. 9, and all the other components are identical to those in the embodiment shown in FIG. 9.

Figure 11:
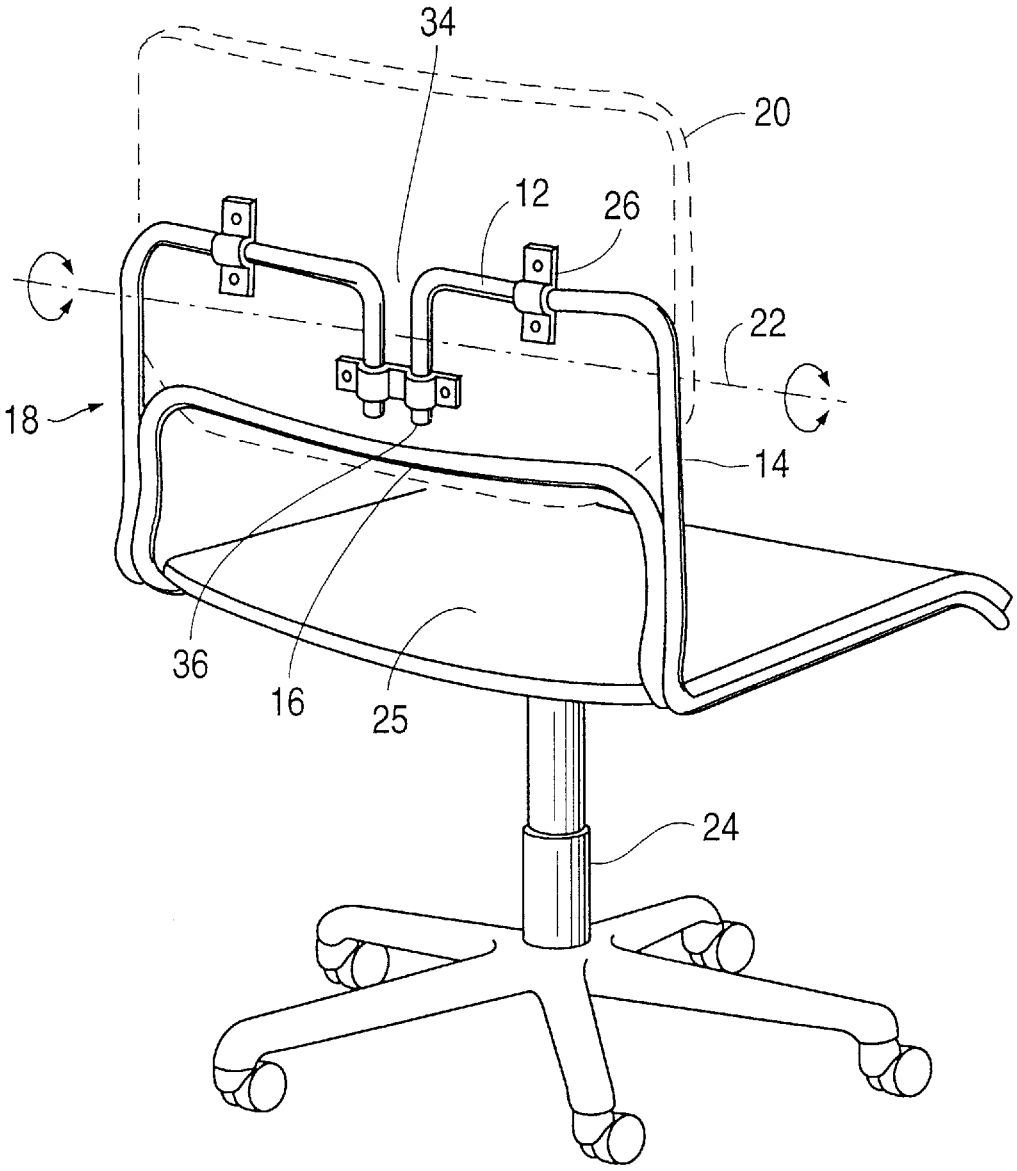
FIG. 11 is a perspective view showing the rear side of a preferred embodiment.

FIG. 11 shows a different preferred embodiment.

This preferred embodiment is characterized in that the upper members 12 of the backrest tubular frame 18 include base ends 34 and downwardly extending lower ends 36 and the backrest 20 is attached to the lower ends 36 of the respective upper members 12 and the base ends 34 thereof. All the other components are identical to those of the embodiment shown in FIG. 7.

Accordingly, a hypothetical rotating axis 22 is formed between the lower ends 36 of the respective upper members 12 and the base ends 34 thereof, and the backrest 20 is inclined backward by pivoting around this hypothetical rotating axis.

Figure 12:
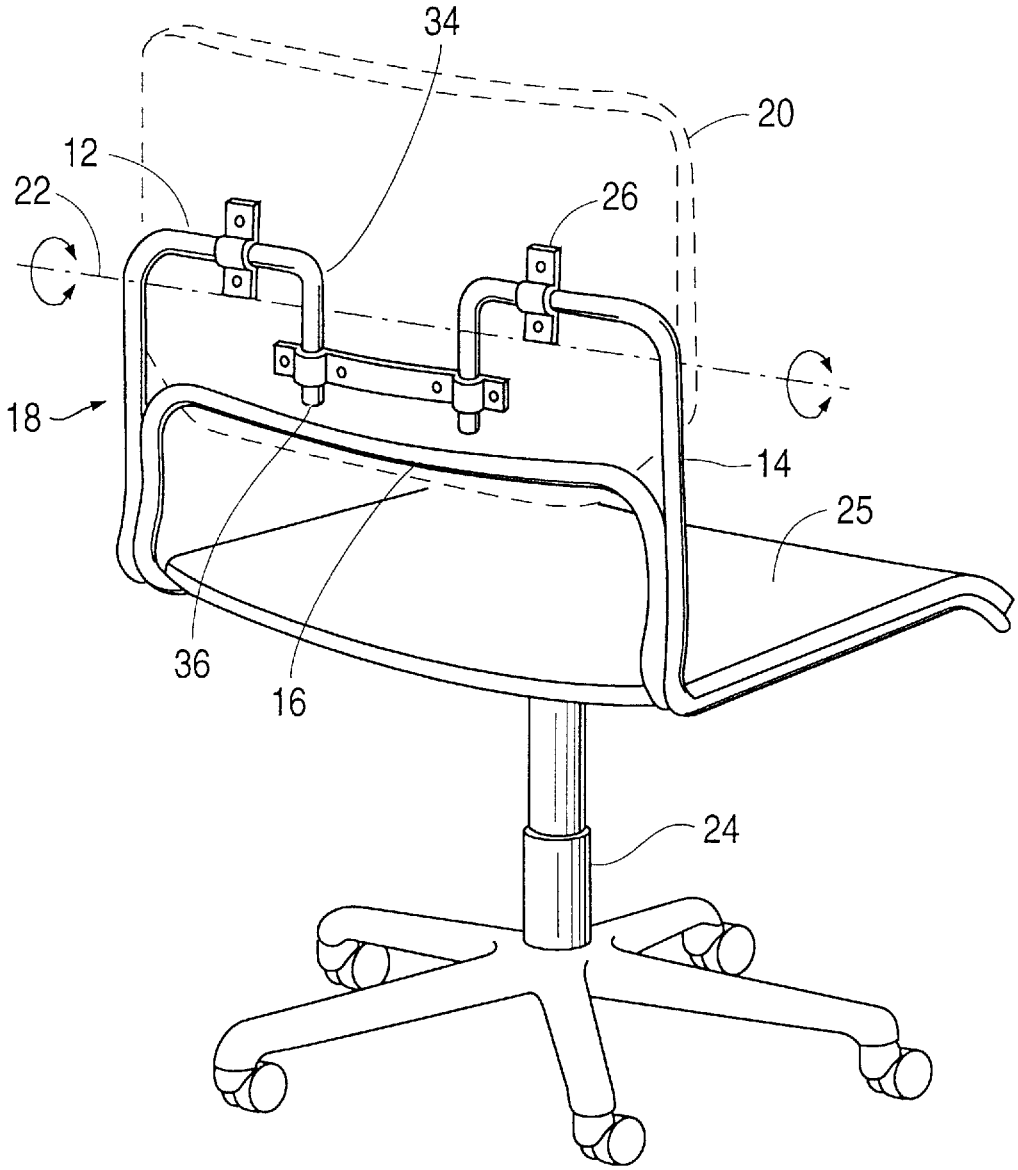
FIG. 12 is a perspective view showing the rear side of a different preferred embodiment.

FIG. 12 shows a different preferred embodiment.

In this preferred embodiment, an appointed interval is provided between the downwardly extending lower ends 36 of the respective upper members 12 in a chair shown in FIG. 11, and all the other components are the same as those of the embodiment shown in FIG. 11.

Figure 13:
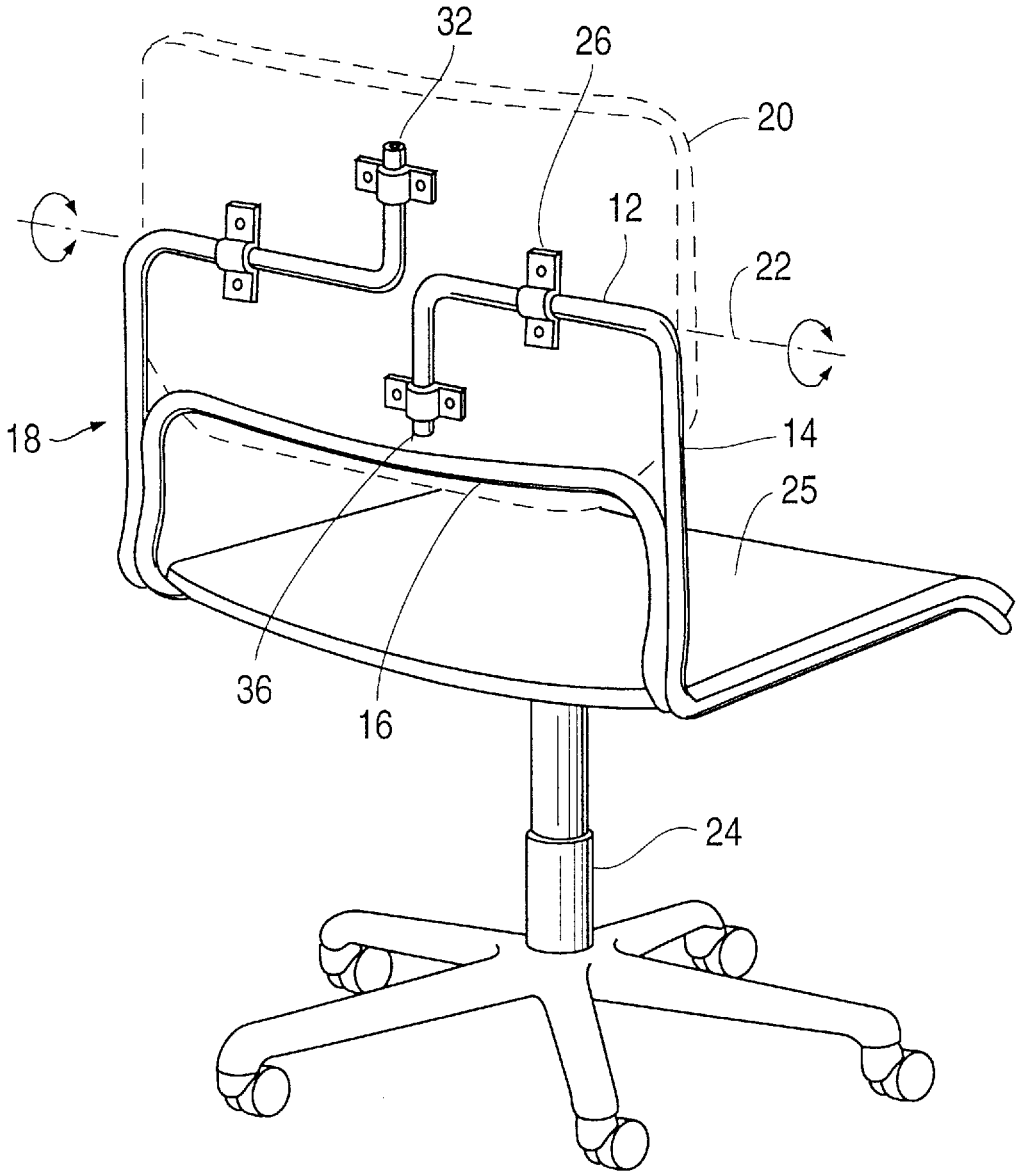
FIG. 13 is a perspective view showing the rear side of a different preferred embodiment.

FIG. 13 shows a different preferred embodiment.

This preferred embodiment is characterized in that one of the upper members 12 (the left member in FIG. 13) of the backrest tubular frame 18 includes a base member 34 and a upwardly extending upper end 32, and the other one of the upper members 12 (the right member in FIG. 13) includes a base member 34 and a downwardly extending lower member 36. The backrest 20 is attached to the upper and lower ends 32, 36 of the respective upper members 12 and the base ends 34 thereof, wherein all the other components are identical to those in the embodiment shown in FIG. 7.

Therefore, a hypothetical rotating axis 22 is formed between the upper end 32 of the one upper members 12 and the lower end 36 of the other upper member 12, and the backrest 20 is inclined backward by pivoting around this hypothetical rotating axis 22.

Figure 14:
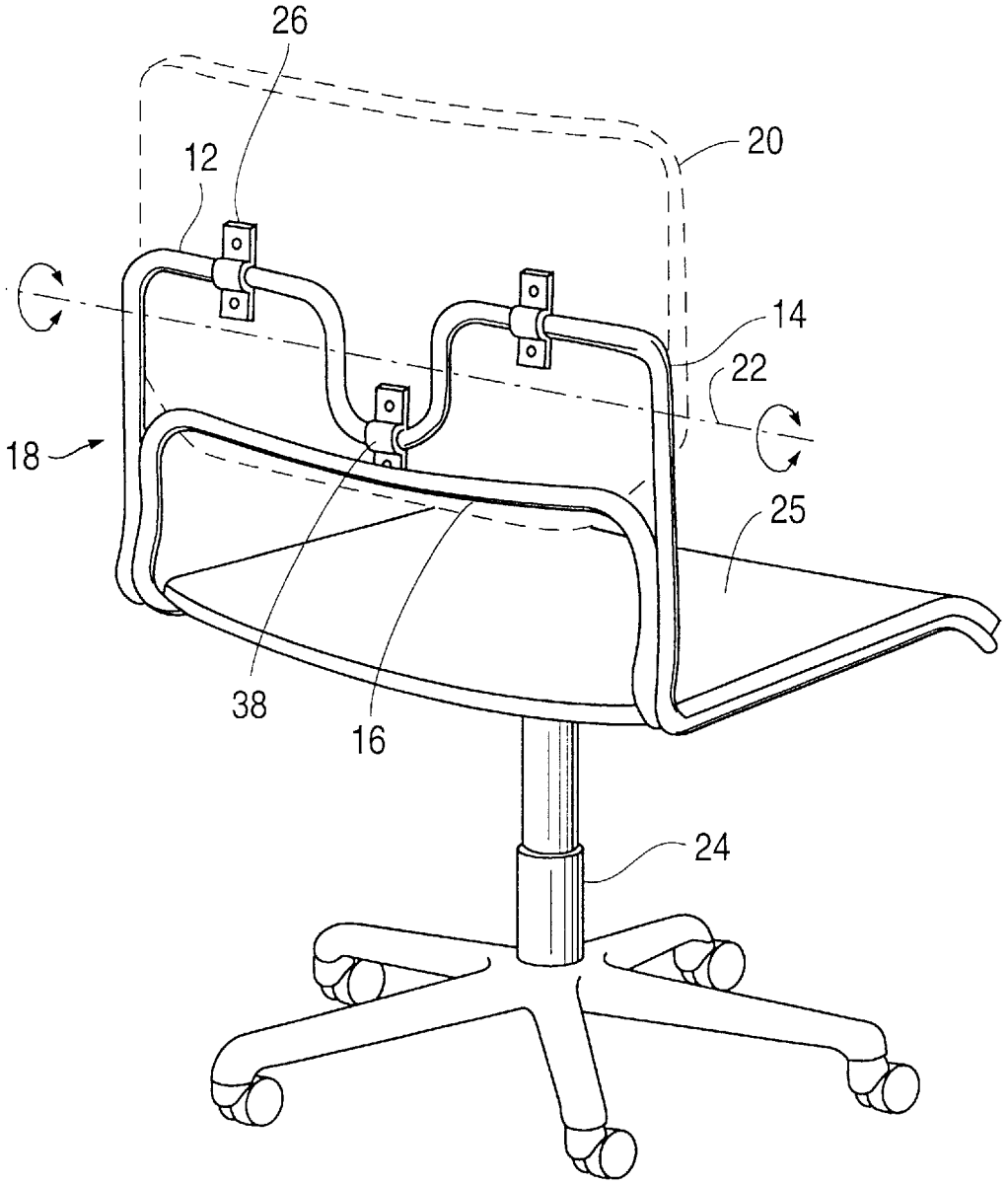
FIG. 14 is a perspective view showing the rear side of a different preferred embodiment.

FIG. 14 shows a different preferred embodiment.

This preferred embodiment is characterized in that the upper member 12 of the backrest tubular frame 18 base ends 34 and, at its middle a downwardly curved lower end 38 and the backrest 20 is attached to the base ends 34 and the curved lower end 38. All the other components are the same as those of the preferred embodiment in FIG. 7.

A hypothetical rotating axis 22 is therefore formed between the curved lower end 38 and the base end 34 of the upper member 12, and the backrest is inclined backward by pivoting around this hypothetical rotating axis 22.

Figure 15:
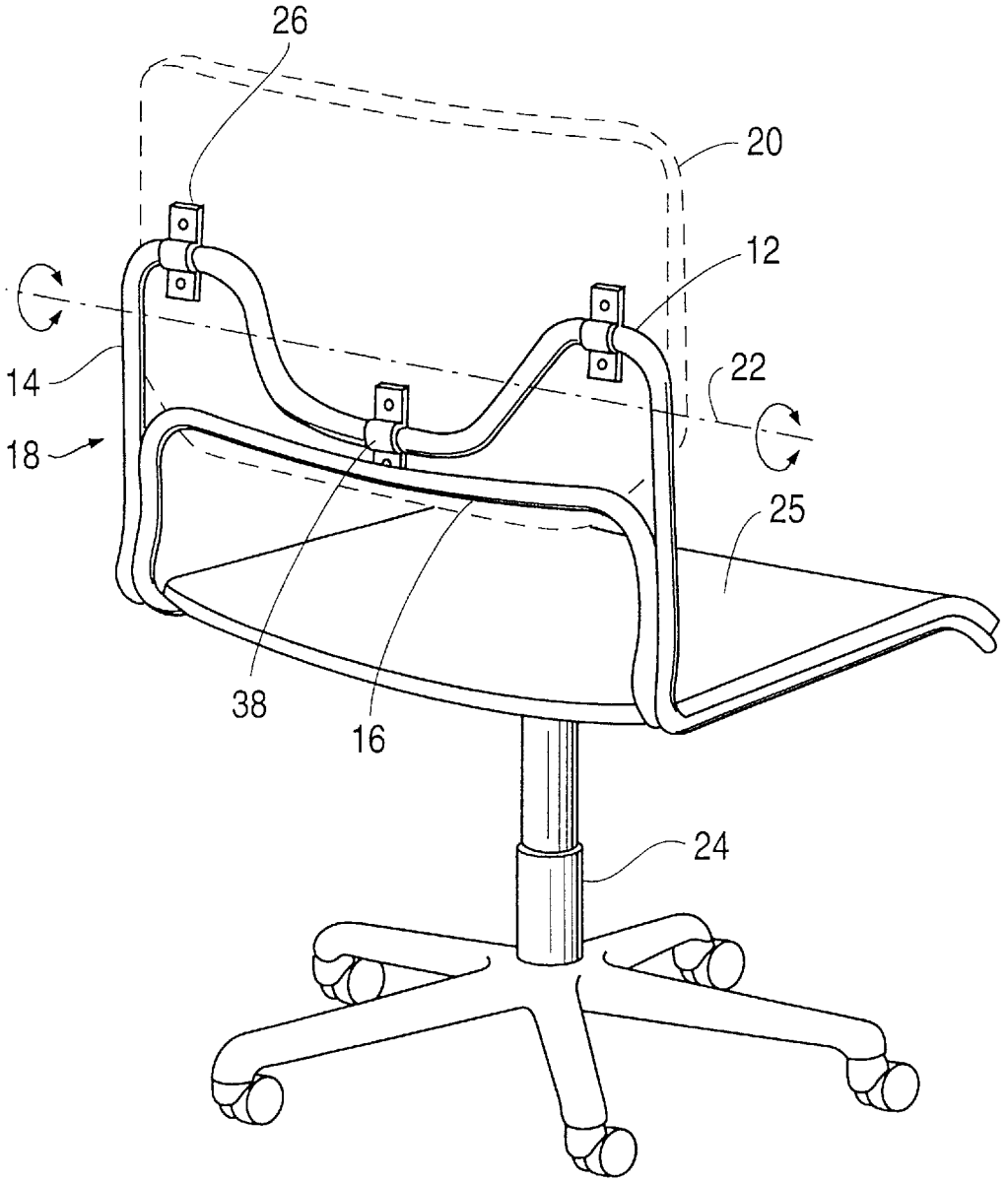
FIG. 15 is a perspective view showing the rear side of a different preferred embodiment.

Furthermore, FIG. 15 shows a different preferred embodiment.

This preferred embodiment is characterized in that the downwardly curved lower end 38 of the upper member 12 is enlarged relative to that of the preferred embodiment shown in FIG. 14. All the other components are identical to those of the embodiment illustrated in FIG. 14.

Figure 16:
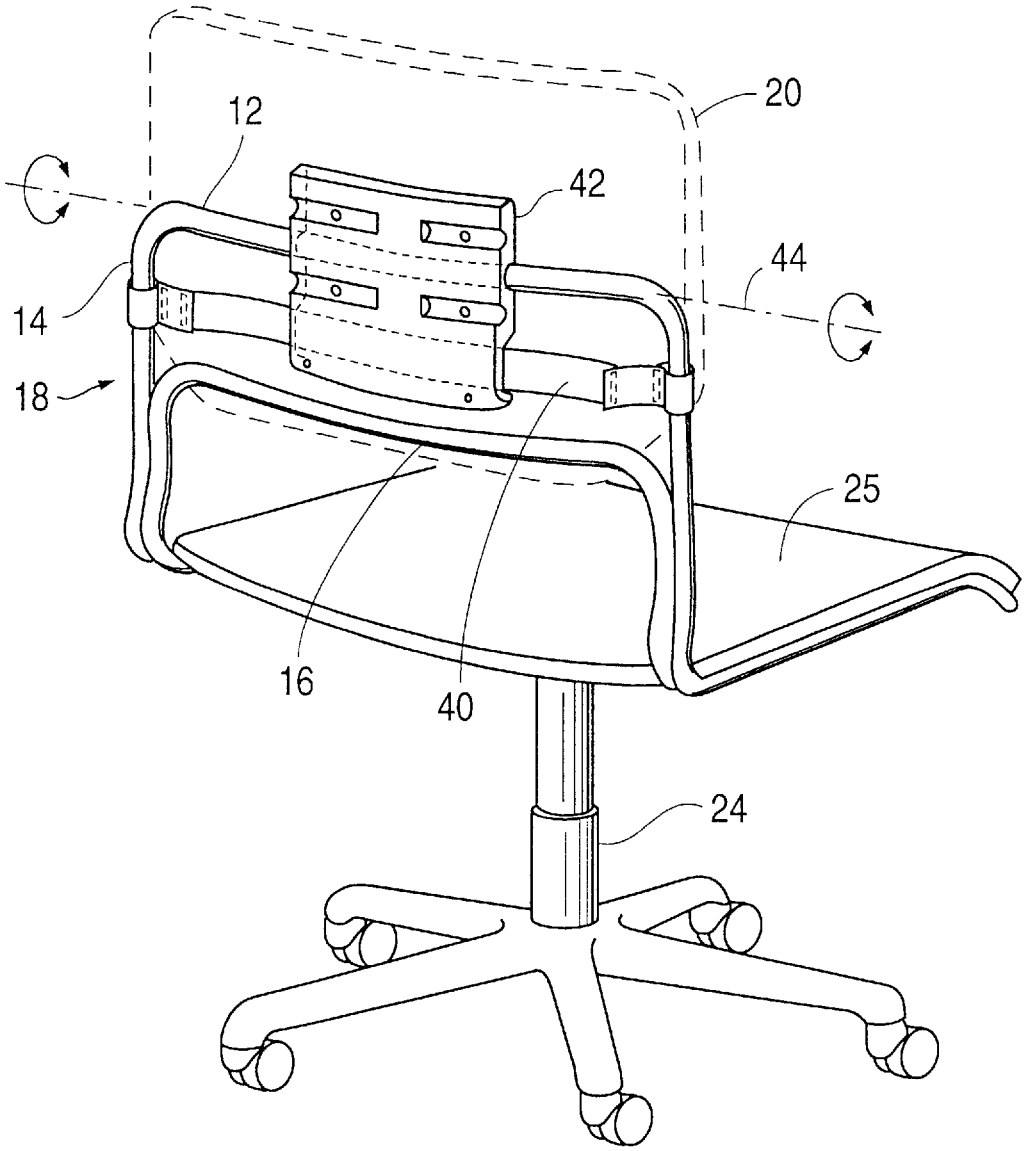
FIG. 16 is a perspective view showing the rear side of a different preferred embodiment.

FIG. 16 shows a different preferred embodiment. A description will be given below of this preferred embodiment.

A band 40 having elasticity is disposed in parallel to the upper member 12 between the upper member 12 of the backrest tubular frame 18 and the lower member 16.

The band 40 according to this preferred embodiment may be of any material which has elasticity. However, a rubber material is preferable.

The backrest attaching plate 42 is pivotally seated at the upper member 12 of the backrest tubular frame 18 and is fixed on the band 40.

A backrest attaching plate 42 according to the preferred embodiment may be anything on which the backrest 20 can be mounted. It is preferable that the backrest attaching plate 42 is made of resin.

The backrest 20 is attached to the backrest attaching plate 42.

A method for inclining the backrest of a chair according to the preferred embodiment is characterized in that the backrest 20 is inclined backward with the upper member 12 of the backrest tubular frame 18 made a rotating axis 44, along with the backrest attaching plate 42 by only a user placing his or her weight onto the backrest 20.

At this time, since a pressing force (rebounding force) which causes the backrest 20 to be pushed back by the elasticity of the band 40 fixed at the backrest attaching plate 42 acts against the weight (force) applied by a user, the inclination position of the backrest 20 is thus controlled, whereby a sense of comfortable seating is given to the user.

I claim:

1. A chair having an inclinable backrest, said chair comprising:

a tubular backrest frame including a pair of spaced apart side members, an upper member extending between said side members, and a lower member extending between said side members and disposed below said upper member;

a backrest attaching device, mounted to said upper member, for use in attaching the backrest to said tubular backrest frame;

wherein said upper member comprises two separated upper member portions, and said upper member portions respectively include base ends which are substantially parallel with one another; and wherein said upper member is secured to said backrest attaching device in at least two locations spaced vertically apart to allow pivoting of the backrest about a horizontal pivot axis, and such that pivoting of the backrest will cause a twisting of said upper member to create a resistance force which resists the twisting and thus resists the pivoting of the backrest.

2. A chair as recited in claim 1, wherein said upper member portions are disposed substantially horizontally and in parallel with one another, and are respectively attached to said backrest attaching device at vertically spaced apart locations; and said pivot axis is disposed between and substantially parallel to said upper member portions.

3. A chair as recited in claim 1, wherein each of said upper member portions includes a generally horizontal base end attached to said backrest attaching device at a first location, and an upper end extending upwardly from said base end and attached to said backrest attaching device at a second location spaced above said first location; and said pivot axis is disposed substantially horizontal and extends across said upper ends of said upper member portions.

4. A chair as recited in claim 1, wherein each of said upper member portions includes a generally horizontal base end attached to said backrest attaching device at a first location, and a lower end extending downwardly from said base end and attached to said backrest attaching device at a second location below said first location; and said pivot axis is disposed substantially horizontal and extends across said lower ends of said upper member portions.

5. A chair as recited in claim 1, wherein one of said upper member portions includes a generally horizontal base end, and a lower end extending downwardly from said base end and attached to said backrest attaching device at a first location; and the other of said upper member portions includes a generally horizontal base end, and an upper end extending upwardly from said base end and attached to said backrest attaching device at a second location above said first location; and said pivot axis is disposed substantially horizontal.

6. A chair as recited in claim 1, wherein said upper member comprises two generally horizontal base portions attached to said backrest attaching device at first locations, and a downwardly curved lower portion connecting between said base portions and attached to said backrest attaching device at a second location below said first locations; and said pivot axis is disposed horizontally, below said base portions of said upper member, and crosses said lower portion of said upper member.

7. A method having an inclinable backrest, said method comprising:

providing a tubular backrest frame including a pair of spaced apart side members, an upper member extending between said side members, and a lower member extending between said side members and disposed below said upper member;

providing a backrest attaching device, mounted to said upper member, and attaching the backrest to said tubular backrest frame;

wherein said upper member comprises two separated upper member portions, and said upper member portions respectively include base ends which are substantially parallel with one another;

wherein said upper member is secured to said backrest attaching device in at least two locations spaced vertically apart to allow pivoting of the backrest about a horizontal pivot axis; and pivoting the backrest about said horizontal pivot axis to cause a twisting of said upper member to create a resistance force which resists the twisting and thus resists the pivoting of the backrest.

8. A method as recited in claim 7, wherein said upper member portions are disposed substantially horizontally and in parallel with one another, and are respectively attached to said backrest attaching device at vertically spaced apart locations; and said pivot axis is disposed between and substantially parallel to said upper member portions.

9. A method as recited in claim 7, wherein each of said upper member portions includes a generally horizontal base end attached to said backrest attaching device at a first location, and an upper end extending upwardly from said base end and attached to said backrest attaching device at a second location spaced above said first location; and said pivot axis is disposed substantially horizontal and extends across said upper ends of said upper member portions.

10. A method as recited in claim 7, wherein each of said upper member portions includes a generally horizontal base end attached to said backrest attaching device at a first location, and a lower end extending downwardly from said base end and attached to said backrest attaching device at a second location below said first location; and said pivot axis is disposed substantially horizontal and extends across said lower ends of said upper member portions.

11. A method as recited in claim 7, wherein one of said upper member portions includes a generally horizontal base end, and a lower end extending downwardly from said base end and attached to said backrest attaching device at a first location; and the other of said upper member portions includes a generally horizontal base end, and an upper end extending upwardly from said base end and attached to said backrest attaching device at a second location above said first location; and said pivot axis is disposed substantially horizontal.

12. A method as recited in claim 7, wherein said upper member comprises two generally horizontal base portions attached to said backrest attaching device at first locations, and a downwardly curved lower portion connecting between said base portions and attached to said backrest attaching device at a second location below said first locations; and said pivot axis is disposed horizontally, below said base portions of said upper member, and crosses said lower portion of said upper member.

* * * * *